US005904871A

United States Patent [19]

Sakai et al.

[11] Patent Number: 5,904,871

[45] Date of Patent: May 18, 1999

[54] IMAGE HEATING DEVICE

[75] Inventors: Hiroaki Sakai; Hiroshi Kataoka, both of Susono, Japan

[73] Assignee: Canon Kabushiki Kaisha, Tokyo, Japan

[21] Appl. No.: 08/733,328

[22] Filed: Oct. 17, 1996

[30] Foreign Application Priority Data

Oct. 19, 1995 [JP] Japan ..... 7-271263

[51] Int. Cl.[6] ..... G03G 15/20

[52] U.S. Cl. ..... 219/216; 399/69

[58] Field of Search ..... 219/216, 469–471; 399/330–335, 69; 432/60, 228; 492/46; 118/60

[56] References Cited

U.S. PATENT DOCUMENTS

| | | | |
|---|---|---|---|
| 4,551,007 | 11/1985 | Elter | 219/216 |
| 4,684,784 | 8/1987 | Tamary | 219/216 |
| 5,191,375 | 3/1993 | Hamilton | 219/216 |
| 5,331,384 | 7/1994 | Otsuka . | |
| 5,444,521 | 8/1995 | Tomoyuki et al. | 399/69 |
| 5,481,346 | 1/1996 | Ohzeki . | |
| 5,493,378 | 2/1996 | Jamzadeh et al. | 219/216 |
| 5,512,992 | 4/1996 | Kim et al. . | |
| 5,512,993 | 4/1996 | Endo et al. | 219/216 |
| 5,517,284 | 5/1996 | Ohtake et al. . | |
| 5,534,987 | 7/1996 | Ohtsuka et al. | 219/216 |
| 5,552,874 | 9/1996 | Ohtsuka et al. | 399/335 |
| 5,572,306 | 11/1996 | Goto et al. | 399/69 |
| 5,581,341 | 12/1996 | Tanaka | 219/216 |
| 5,671,462 | 9/1997 | Toyohara et al. | 399/330 |

FOREIGN PATENT DOCUMENTS

| | | |
|---|---|---|
| 523638 | 1/1993 | European Pat. Off. . |
| 564420 | 10/1993 | European Pat. Off. . |
| 2-062575 | 3/1990 | Japan . |

*Primary Examiner*—Teresa Walberg
*Assistant Examiner*—J. Pelham
*Attorney, Agent, or Firm*—Fitzpatrick, Cella, Harper & Scinto

[57] ABSTRACT

This invention relates to an image heating device comprising a heating member, a backup member for forming a nip in cooperation with the heating member, a temperature detecting element for detecting a temperature of the heating member, and heating condition determination means for determining a heating condition, according to a change rate of the temperature detected by the temperature detecting element while a recording sheet is held in the nip.

4 Claims, 12 Drawing Sheets

FIG. 13

| LIGHTING RATIO / SHEET SIZE | 4a : 4b |
|---|---|
| A3 | 5 : 5 |
| B4 | 5 : 3 |
| A4 LONGITUDINAL | 5 : 1 |

FIG. 14

| LIGHTING RATIO / SHEET SIZE | 4a : 4b |
|---|---|
| A3 | 5 : 4 |
| B4 | 5 : 2 |
| A4 LONGITUDINAL | 5 : 0 |

IMAGE HEATING DEVICE

BACKGROUND OF THE INVENTION

1. Field of the Invention

The present invention relates to an image heating device for heating an image borne by a recording sheet.

2. Related Background Art

In the image forming apparatus for transferring a toner image on a recording sheet and heating such transferred image to obtain a permanent image, there is conventionally employed an image heating device as shown in FIG. 1.

Referring to FIG. 1, a heating roller 1 is composed for example of a metallic core 11 such as of aluminum or iron, and a releasing resinous layer 12 such as of PFA or PTFE, and is heated internally by means of heater 4. The temperature of the heating roller 1 is detected as the surface temperature thereof by a temperature detecting element 3 maintained in contact with the heating roller 1, and the surface temperature is maintained at a predetermined temperature by intermittent activation of the heater 4 by means of a temperature control circuit (not shown). The temperature detecting element can be positioned within the passing area of the recording sheet in case of the image heating device equipped with cleaning means, but, in case of the image heating device lacking such cleaning means, it is generally provided in a non-image area in order to prevent smear on the image.

A pressure roller 2, rotated in pressure contact with the heating roller 1, is composed of a metallic core 13 such as of aluminum or iron, a heat-resistant elastic layer 14 such as of silicone rubber or silicone sponge of a low hardness provided thereon, and a surfacial covering layer 15 composed of a releasing resinous material such as PFA or PTFE.

A recording sheet P, bearing a toner image T thereon, is guided by an entrance guide 6 to the nip between the heating roller 1 and the pressure roller 2, and is subjected to image fixation under heat and pressure. The entrance guide 6 is generally composed of a controlled resistance material such as PBT (having a resistance of $10^8$ to $10^{10}\cdot\Omega$), or has a metallic guide surface such as of stainless steel and employs the above-mentioned controlled resistance material at the junction with a fixing frame. This is to avoid drawbacks such as toner scattering, caused by electrostatic charging of the guide surface resulting from the friction contact with the recording sheet if the entrance guide is composed of an insulating material. Also in order to avoid the generation of crease in the recording sheet P in the passing thereof through the nip, it is customary to provide the heating roller 1 and the pressure roller 2 with adequate inverse crowning in the longitudinal direction thereof and to adequately adjust the position of entry of the recording sheet into the nip between the heating roller and the pressure roller, by means of the entrance guide 6.

In such an image heating device, the thickness of the heating roller 1 is often made equal to or less than 1.0 mm, in order to reduce the heat capacity of the heating roller, thereby shortening the warm-up time. In such structure, if only one heater is employed, there is encountered an excessively high temperature in the non-passing area of the recording sheet, particularly in case of printing with small-sized sheets. Particularly in a high-speed apparatus, the printing speed has to be significantly lowered in such printing with small-sized sheets.

For avoiding such a drawback, there is proposed a configuration employing two heaters of different heat distributions. FIG. 2 shows the cross-sectional structure of such configuration, and FIG. 3 shows the heat distribution of the heaters and the arrangement of segments. The illustrated heat distribution of the heaters is designed for sheet transportation with the reference position at the center. A heater 4*a* is used for the printing of a small-sized sheet, and has heat distribution in a portion where the heat is absorbed by the sheet. The heater 4*b* is used, in combination with the heater *4*a, for the printing of a large-sized sheet. FIG. 13 shows the heater lighting ratio for different sheet sizes. For the lighting of the heater 4*a* for 500 msec., the heater 4*b* is turned on for 500 msec in case of printing an A3-sized sheet, 300 msec in case of printing a B4-sized sheet and 100 msec in case of printing a longitudinally-oblong A4-sized sheet. Such lighting ratios are generally so selected as to obtain a substantially flat temperature distribution on the heating roller, for the sheets of a most frequently used weight range of 65 to 80 g/m$^2$.

In the image heating device of the above-explained configuration, because of the limited heat capacity of the heating roller, the temperature distribution on the heating roller becomes different because of the difference in the heat amount carried away by the sheets, depending on the weight thereof. In the continuous printing operation, the temperature distribution (at the thirtieth sheet or thereafter) assumes the form shown in FIG. 4, and, even for the sheets of a same size, the image fixing ability may become deficient by the temperature decrease in the central area, particularly in case of thick recording sheets. This is because the longitudinal heat conduction in the metallic core of the thin heating roller cannot match the supplied heat amount. A similar phenomenon may be caused by a lowered voltage of the power supply. For example a lowering by 15% of the power supply voltage reduces the output of the heater to 78% of the rated power, so that the output of a heater of 800 W is reduced to 623 W. With such lowering of the heater output, the image fixing ability may become deficient at the central area, even for a sheet weight of about 90 g/m$^2$.

Also because of recent wide variety of sheet materials, it is also required to pass a thick sheet such as 128, 160 or 200 g/m$^2$, and the fixing ability may become deficient because of such heavy sheet weight or the variation in the power supply voltage.

SUMMARY OF THE INVENTION

In consideration of the foregoing, an object of the present invention is to provide an image heating device capable of satisfactory image fixation regardless of the kind of the recording sheet or the fluctuation in the power supply voltage.

Another object of the present invention is to provide an image heating device comprising a heating member; a backup member constituting a nip in cooperation with the heating member; a temperature detecting element for detecting the temperature of the heating member; and heating condition determination means for determining the heating condition according to the rate of change of the temperature detected while the recording sheet is held in the nip.

Still other objects of the present invention, and the features thereof, will become fully apparent from the following detailed description, which is to be taken in conjunction with the attached drawings.

BRIEF DESCRIPTION OF THE DRAWINGS

FIG. 13 is a table showing the lighting ratio of two heaters for different sheet sizes, in a normal operation; and FIG. 14 is a table showing the lighting ratio of two heaters for different sheet sizes, in case the temperature increase rate is smaller than a predetermined value.

DESCRIPTION OF THE PREFERRED EMBODIMENTS

Figure 1:
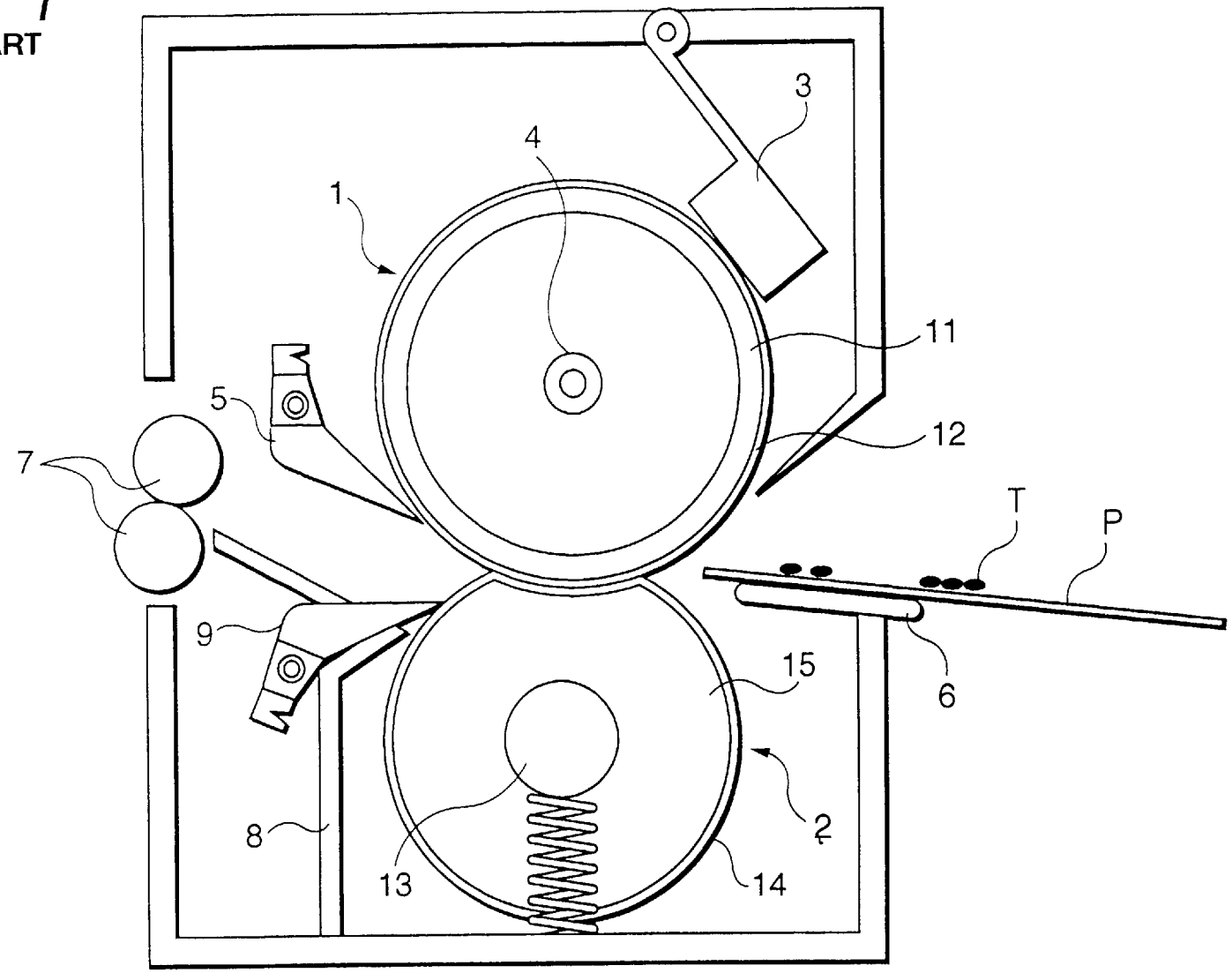
FIG. 1 PRIOR ART
FIG. 1 is a view showing the configuration of an image fixing device utilizing only one heater.
Figure 2:
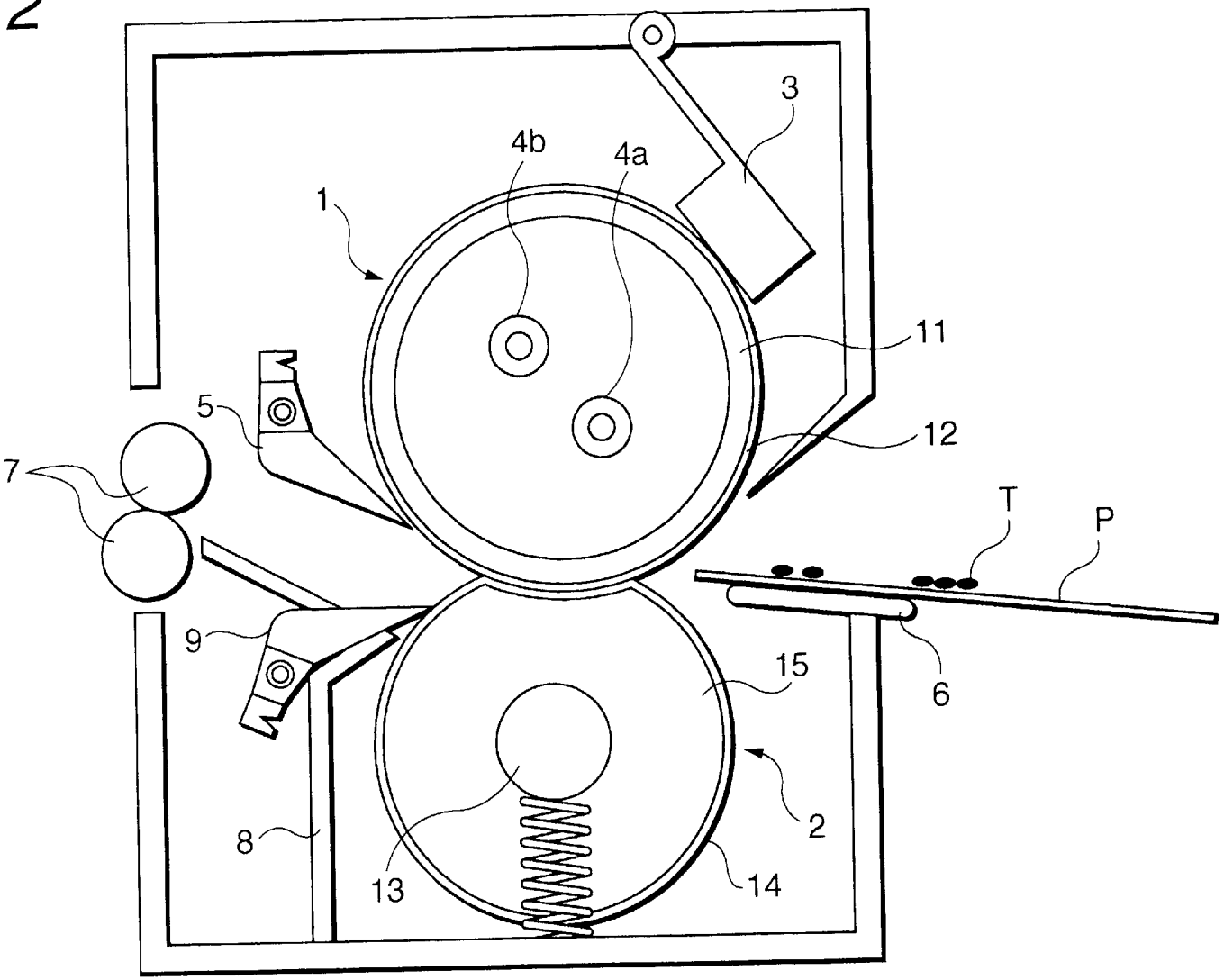
FIG. 2 is a view showing the configuration of an image fixing device utilizing two heaters.
Figure 3:
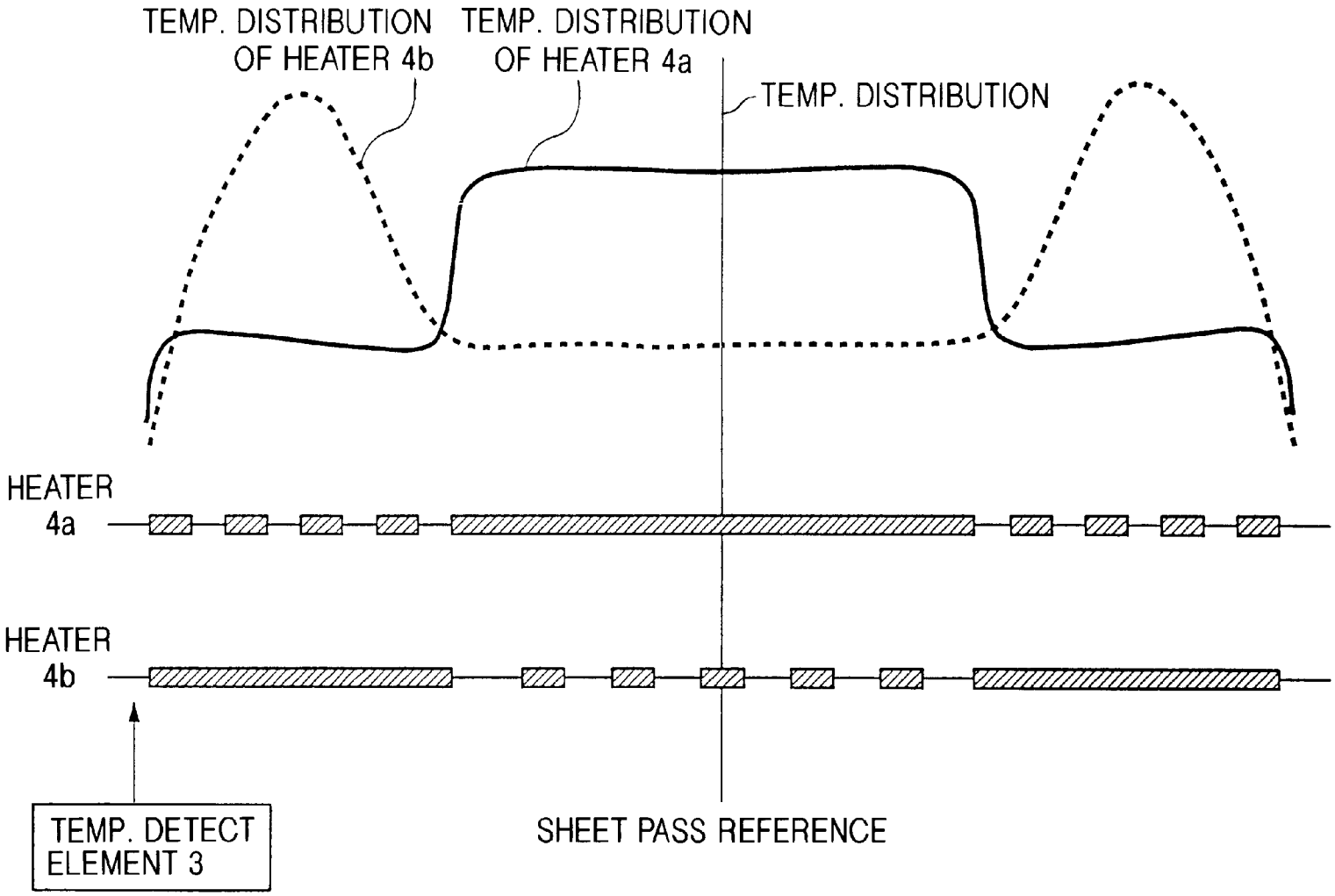
FIG. 3 is a view showing the heat distribution and the segment arrangement in the longitudinal direction, in the configuration with two heaters.

FIG. 2 is a cross-sectional view of a fixing device, constituting an embodiment of the image heating device of the present invention, and FIG. 3 shows the heat distribution of heaters and the arrangement of segments thereof.

In this fixing device, the recording sheets up to A3 size (297 mm in width) are transported with a reference position at the center, so that the heat distribution of the heaters is made symmetrical with respect to the central reference position. Heaters (heat generating members) 4*a*, 4*b* have a rated power of 500 W upon receiving an input voltage of 100 V. A fixing roller (heating member) 1 has a diameter of 40 mm and a thickness of 1.0 mm, and is composed of an aluminum core 11 and a mold releasing PFA layer 12 at the surface.

A pressure roller 2, constituting a backup member for forming a nip with the heating member, has a diameter of 30 mm and a hardness of 50°, is composed of a core 13 of stainless steel, an elastic layer 14 of silicone sponge and a surfacial releasing PFA layer 15, and is adapted to form a nip of a width of 5.0 mm in cooperation with the fixing roller under a pressure of 200 N. A temperature detecting element (thermistor) is provided in a non-image area (non-passing area of the sheets in the present embodiment) where the toner image does not come into contact with the fixing roller, so that the temperature detecting element is free from the toner deposition and the cleaning means can therefore be dispensed with. Such configuration allows printing operation of 30 sheets/minute, with A4-sized sheets transported in the transversally oblong position.

In the following there will be explained the printing operation and the method of measuring the temperature change rate. In the present embodiment, the stand-by temperature is set equal to or lower than the minimum allowable fixing temperature, based on a fact that the image fixation in the initial period of the printing operation can be achieved at a temperature lower than in a continuous printing operation, utilizing the heat capacity of the fixing device. Such setting is selected in order to measure the temperature change rate, by preparing a certain period for reaching the fixing temperature from the stand-by temperature. An experimental measurement indicates that the temperature change rate can be exactly measured and judged if the measuring period is as long as about 5 seconds. Consequently, in the present embodiment, the temperature change rate is measured from the first to third sheets in the continuous printing operation. It is naturally possible also to complete the measurement in the first sheet.

Figure 9:
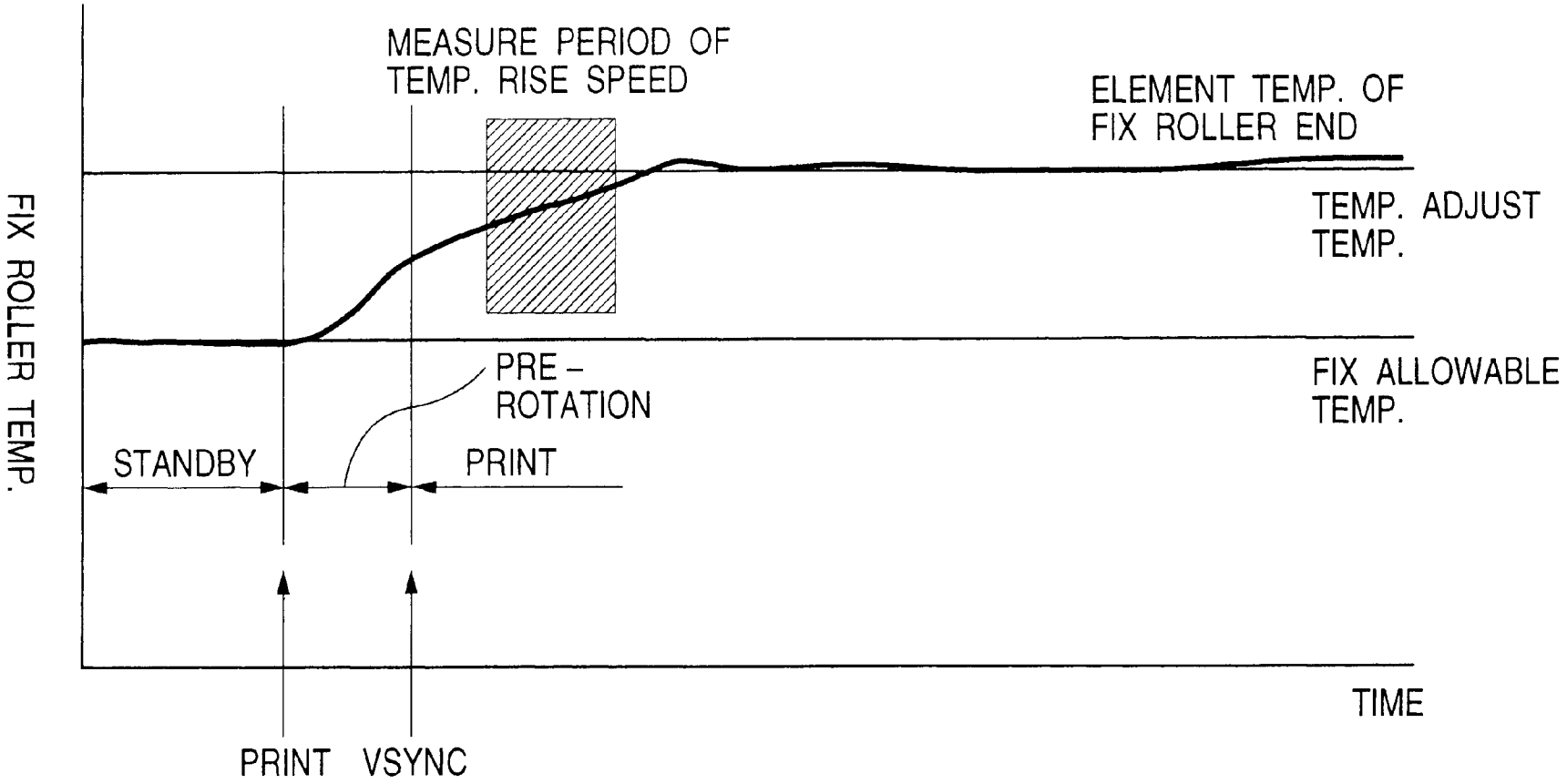
FIG. 9 is a schematic chart showing a measuring period for the temperature change rate.

As shown in FIG. 9, a pre-rotation step initiated in response to a print signal, and the image forming apparatus enters the printing operation from the stand-by state, through the pre-rotation step. A sheet enters the nip after the release of an image writing signal (VSYNC signal) from a video controller (not shown) but before the detected temperature reaches the controlled temperature. In the printing operation with the fixing device of the present embodiment, the printing operation for the 1st sheet is initiated, after the release of the VSYNC signal, with a predetermined lighting ratio of the heaters until the detected temperature reaches the controlled temperature, and the temperature increase rate is measured in the course of the continuous printing operation. More specifically, in the present embodiment, the two heaters are fully turned on (communication duty 100%) from the stand-by temperature to the controlled temperature, and the temperature increase rate is measured with the thermistor.

Figure 11:
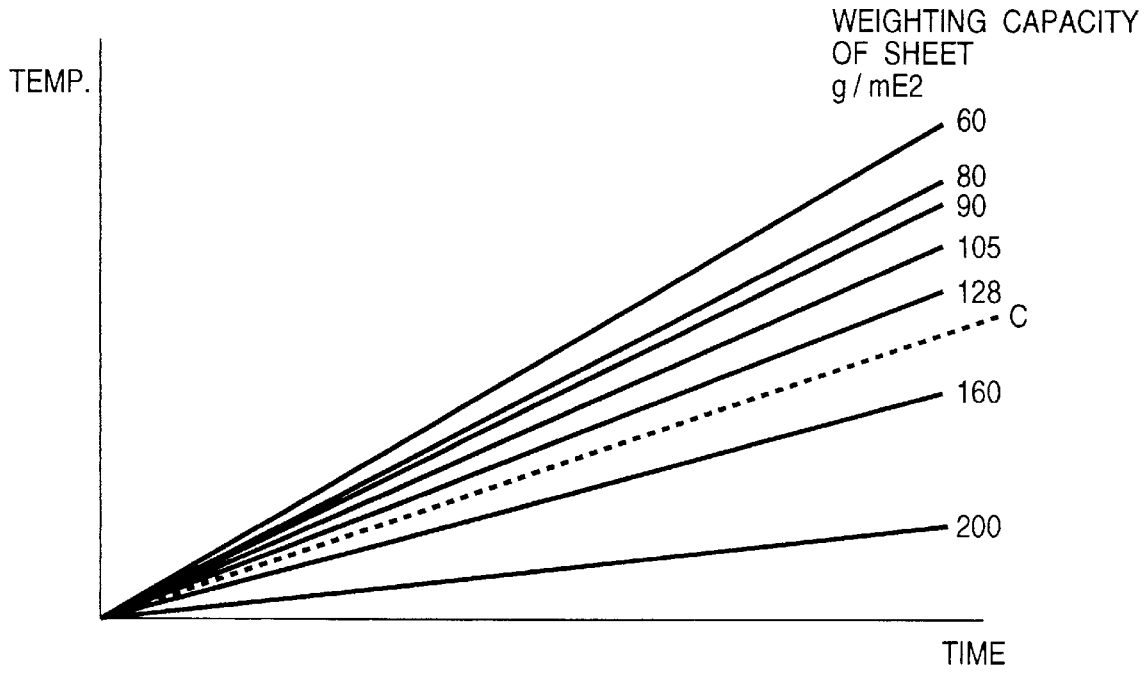
FIG. 11 is a chart showing the difference in the temperature change rate of the fixing roller, depending on the sheet weight.

FIG. 11 shows the temperature increase rate for different paper weights, for an input voltage of 100 V. Based on the temperature distribution on the fixing roller shown in FIG. 4, it is known in advance that the fixation becomes deficient in the continuous printing operation for a recording sheet heavier than 128 g/m$^2$. In the present embodiment, therefore, the image heating condition in the continuous printing operation is switched according to whether the temperature increase rate is larger or smaller than a broken line C in FIG. 11. Such switching is made by a CPU constituting heating condition determination means. More specifically, if the temperature increase rate is smaller than the broken line C, the interval of sheets in the continuous printing operation is made larger than that in the normal operation, thereby preventing the decrease of temperature in the central portion of the fixing roller. The minimum temperature in case of continuous printing of the sheets of 200 g/m$^2$ could be brought into the allowable fixing temperature range, by reducing the throughput for the A4-sized sheets (transported in transversally oblong position) by 20%, from 30 sheets/minute in the normal state to 24 sheets/minute (starting from the fourth sheet in the continuous printing operation).

The present embodiment employs two different intervals of sheets according to the temperature increase rate, but it is also possible to adopt three or more sheet intervals depending on the temperature increase rate. The productivity of the device can be improved by selecting the sheet interval in finer manner.

Figure 4:
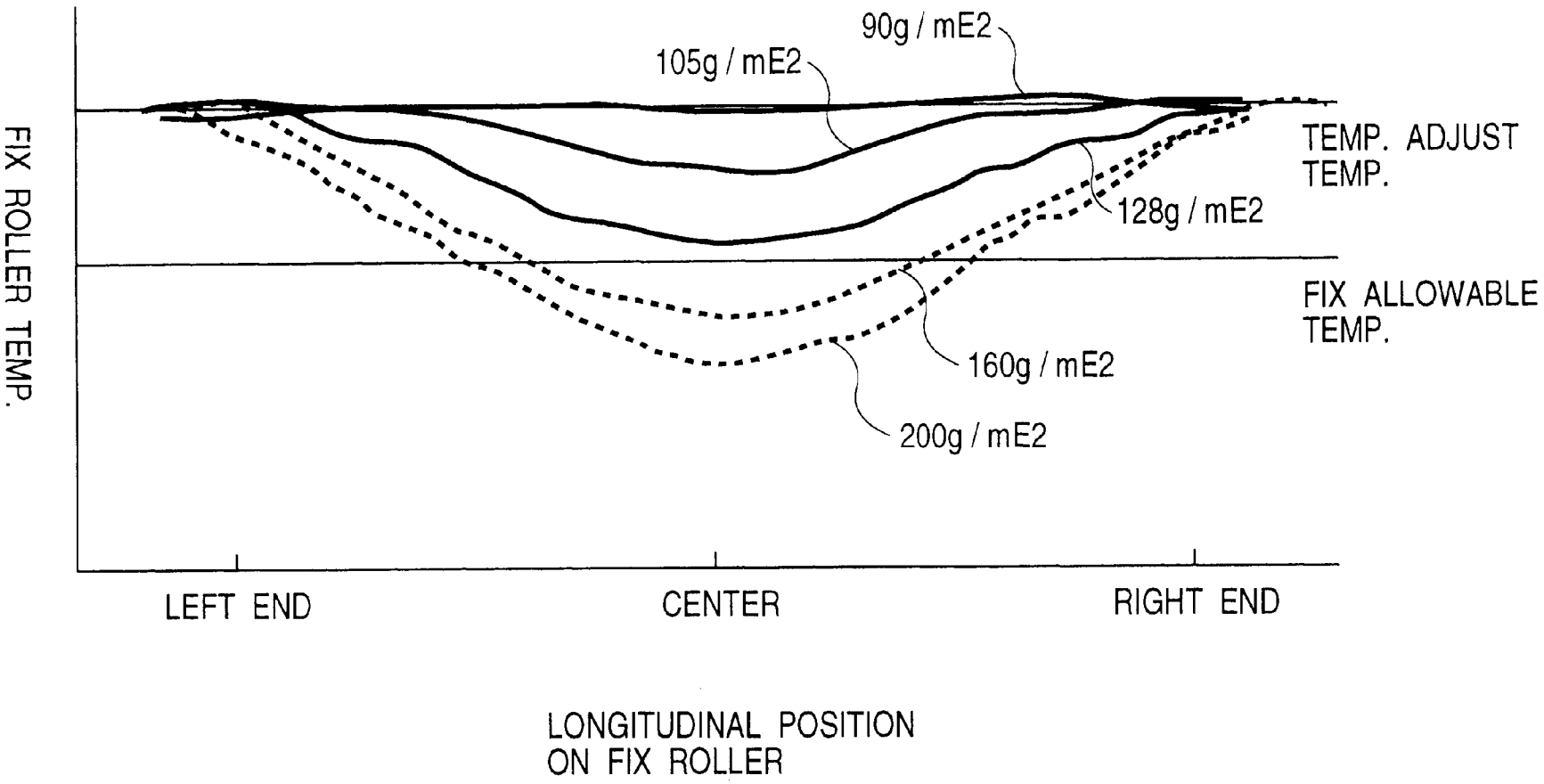
FIG. 4 is a chart showing the temperature distribution on the fixing roller for sheets of a same size with different weights.

In the following there will be explained a second embodiment of the present invention, in which, in case the fixing roller assumes the temperature distribution as shown in FIG. 4 depending on the sheet weight, the fixing ability is secured by modifying the lighting ratio of the heaters in the normal state as shown in FIG. 13.

Figure 5:
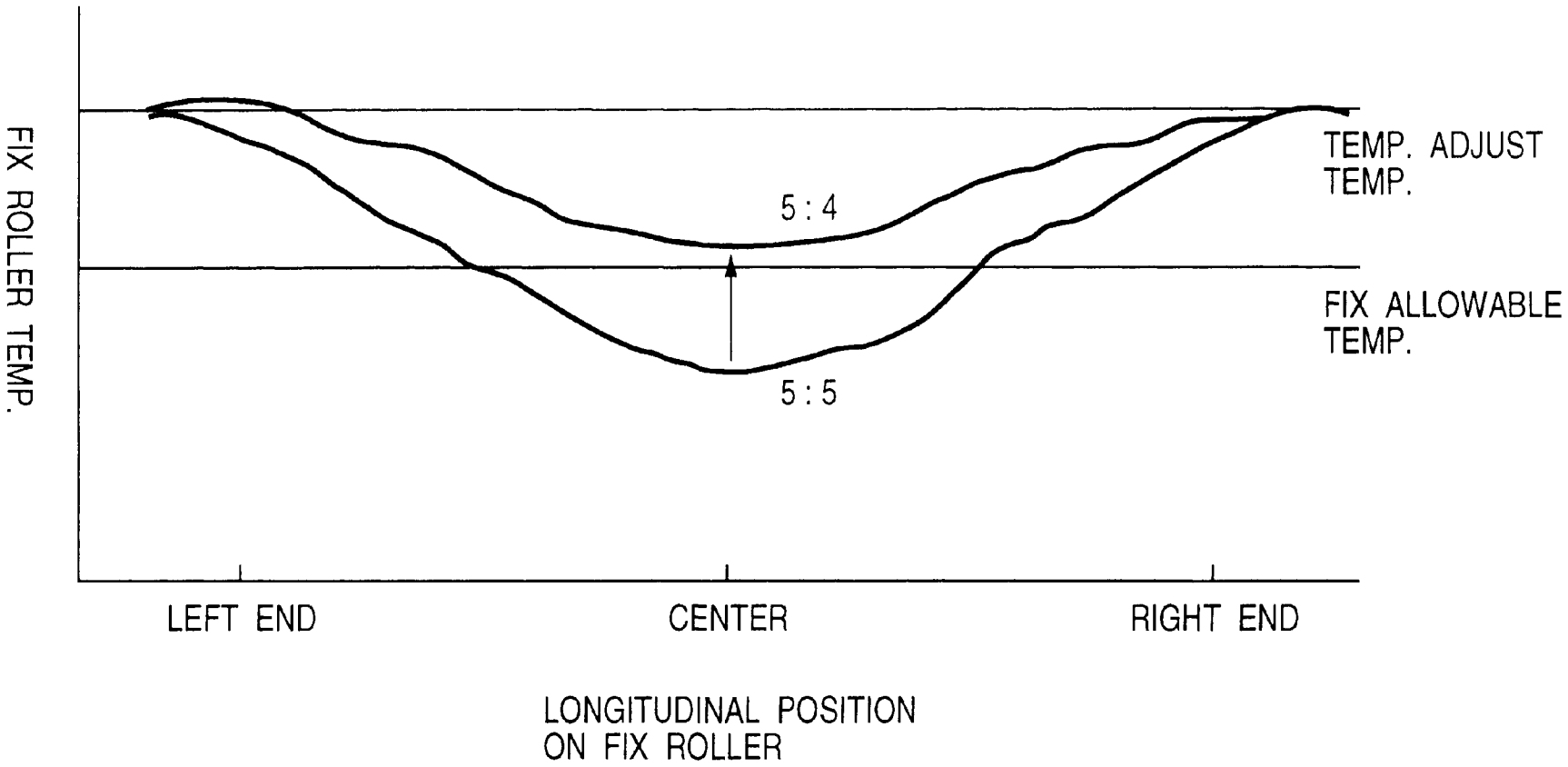
FIG. 5 is a chart showing the change in the temperature distribution on the fixing roller when the lighting ratio of the heaters is varied.

The temperature distribution as shown in FIG. 4 results from the deficiency in heat supply in the central area. Therefore, if a thick sheet is identified from the measurement of the temperature increase rate, conducted for 5 seconds after the entry of the leading end of the sheet into the nip (namely if the slope of temperature increase being smaller than the line C in FIG. 11), the lighting ratio of the heaters is modified as shown in FIG. 14, in order to alter the image heating condition. After the measurement of the temperature increase rate, the ratio of lighting of the heater 4*a* is increased in the 4th and subsequent sheets in the continuous printing operation, thereby increasing the heat supply to the central part of the fixing roller and bringing the minimum temperature in such central part within the allowable fixing temperature range as shown in FIG. 5.

In the foregoing the lighting ratio is varied in only one step, but it is also possible to detect the sheet weight from the actual temperature slope and to modify the lighting ratio in plural steps so as to optimize the temperature distribution of the fixing roller to the sheet weight.

Figure 10:
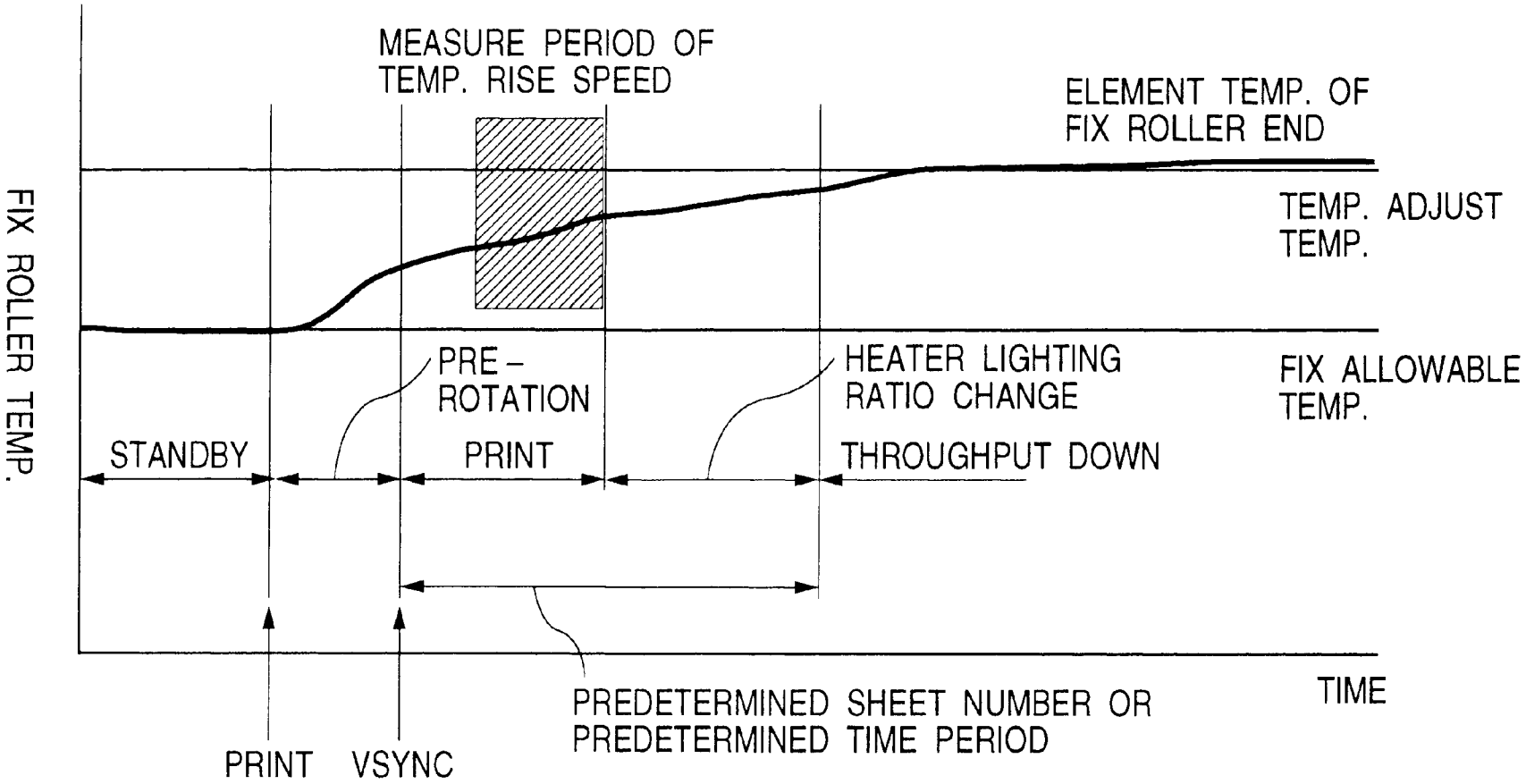
FIG. 10 is a chart showing an embodiment in which the continuous printing is executed with a lighting ratio according to the temperature change rate and the interval of sheets is also switched.

Also in a high-speed apparatus, the fixing ability may not be ensured by the present embodiment only, for example in case of a lowered power supply voltage. In case the control temperature cannot be maintained (the detected temperature does not reach the control temperature or continues to decrease) even with the modification of the lighting ratio of the heaters, the fixing ability is secured by a reduction of the throughput as shown in FIG. 10. The throughput is reduced if the control temperature is not reached after the printing of a predetermined number of sheets after the release of the VSYNC signal, but it is also possible to utilize a timer and to reduce the throughput in case the control temperature is not reached after a predetermined time.

Figure 6:
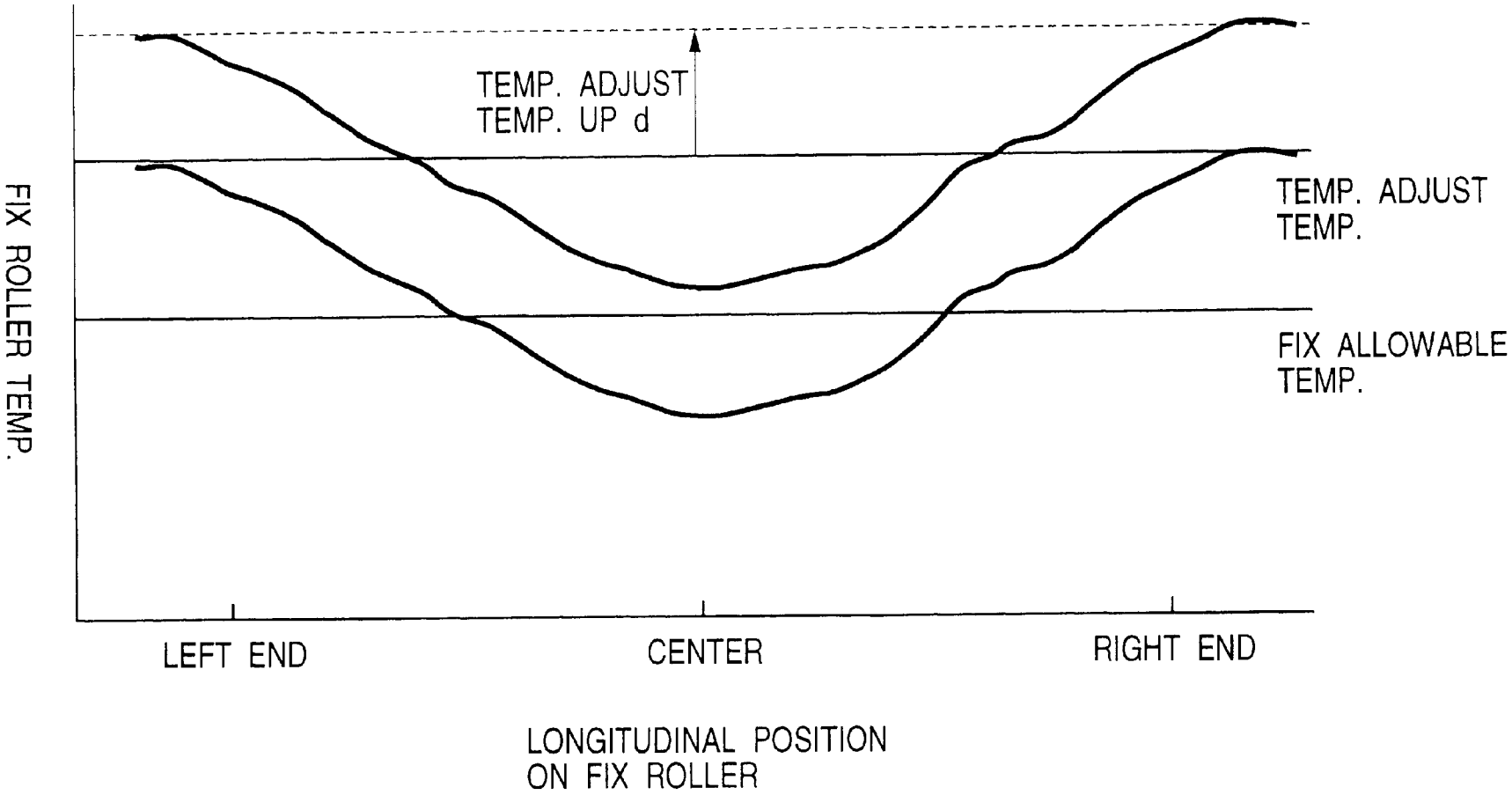
FIG. 6 is a chart showing the change in the temperature distribution on the fixing roller when the controlled temperature is raised.

In the following there will be explained a third embodiment of the present invention, in which, in case the fixing roller assumes the temperature distribution as shown in FIG. 4 because of the high sheet weight and the temperature in the central part of the fixing roller does not reach the allowable fixing temperature, the deficient heat required in the central part as shown in FIG. 6 is secured by an increase in the controlled temperature for fixing. If the lighting ratio of the heaters is weighted at the center, for example in case of the longitudinally oblong A4-sized sheets, the change in the lighting ratio can only scarcely increase the heat supply in the center, in response to an increase in the sheet weight. For example the change from the condition shown in FIG. 13 to that shown in FIG. 14 can only provide a change from 5:1 to 5:0.

In the present embodiment, therefore, in order to bring the minimum temperature of the fixing roller in the continuous printing operation within the allowable fixing temperature range, the sheet weight is identified from the slope of the temperature increase in the first printed sheet and the controlled temperature is raised by d if the slope is smaller than an increase rate C. In case the temperature is controlled by the thermistor provided in the non-image end area, the increase rate C for switching the control is preferably selected for each sheet size, since the temperature increase rate varies depending on the sheet size.

Figure 7:
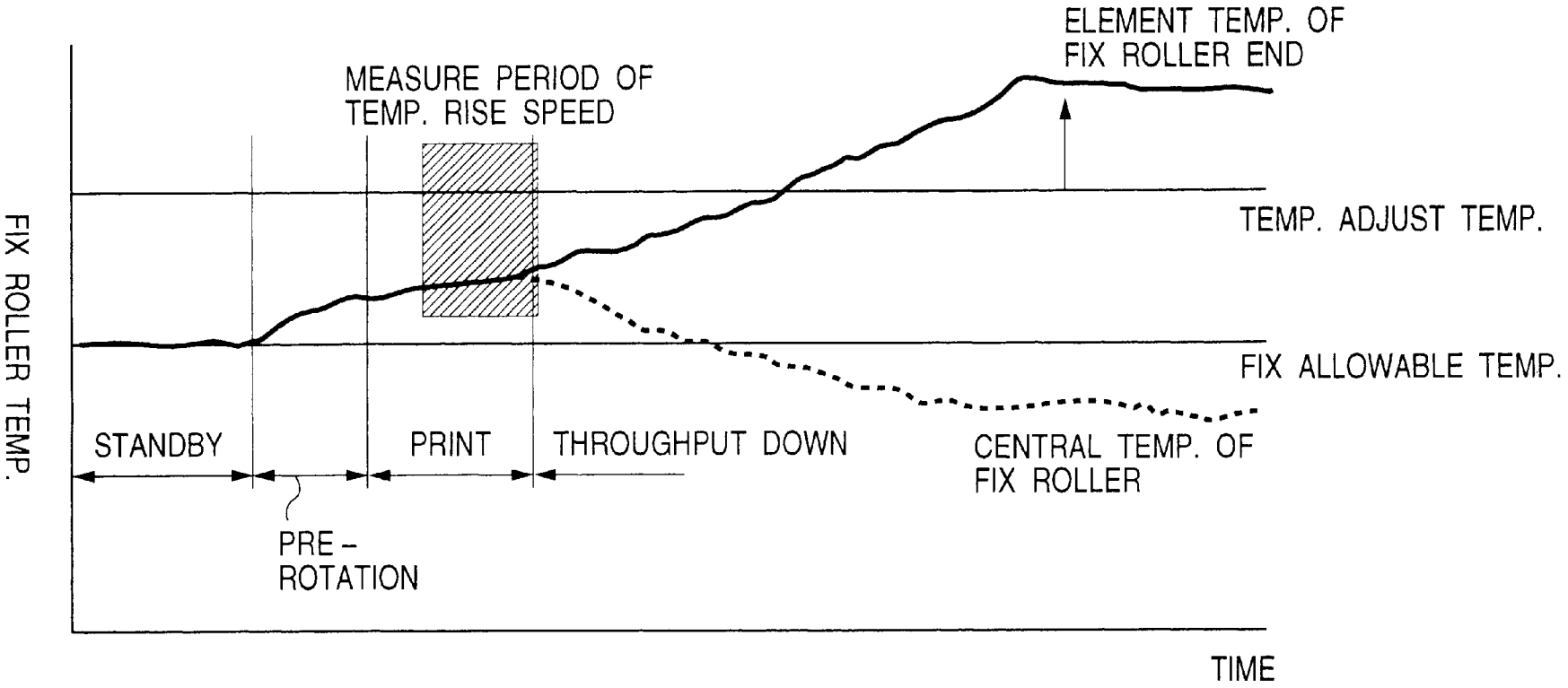
FIG. 7 is a chart showing the change in the temperatures at the center and at the end of the fixing roller.

Also if the temperature difference becomes large between the control part and the end part after the printing of a certain number of sheets, as shown in FIG. 7, and the temperature at the central part cannot be brought into the allowable fixing temperature range even by concentrated activation of the central heater 4*a*, there is adopted a reduction in the throughput. In such case it is necessary to confirm, in advance, the lowering of the central temperature of the fixing roller as a function of the sheet weight, and the throughput is reduced when the temperature increase rate is identified for the recording sheet currently passing through the nip.

Figure 8:
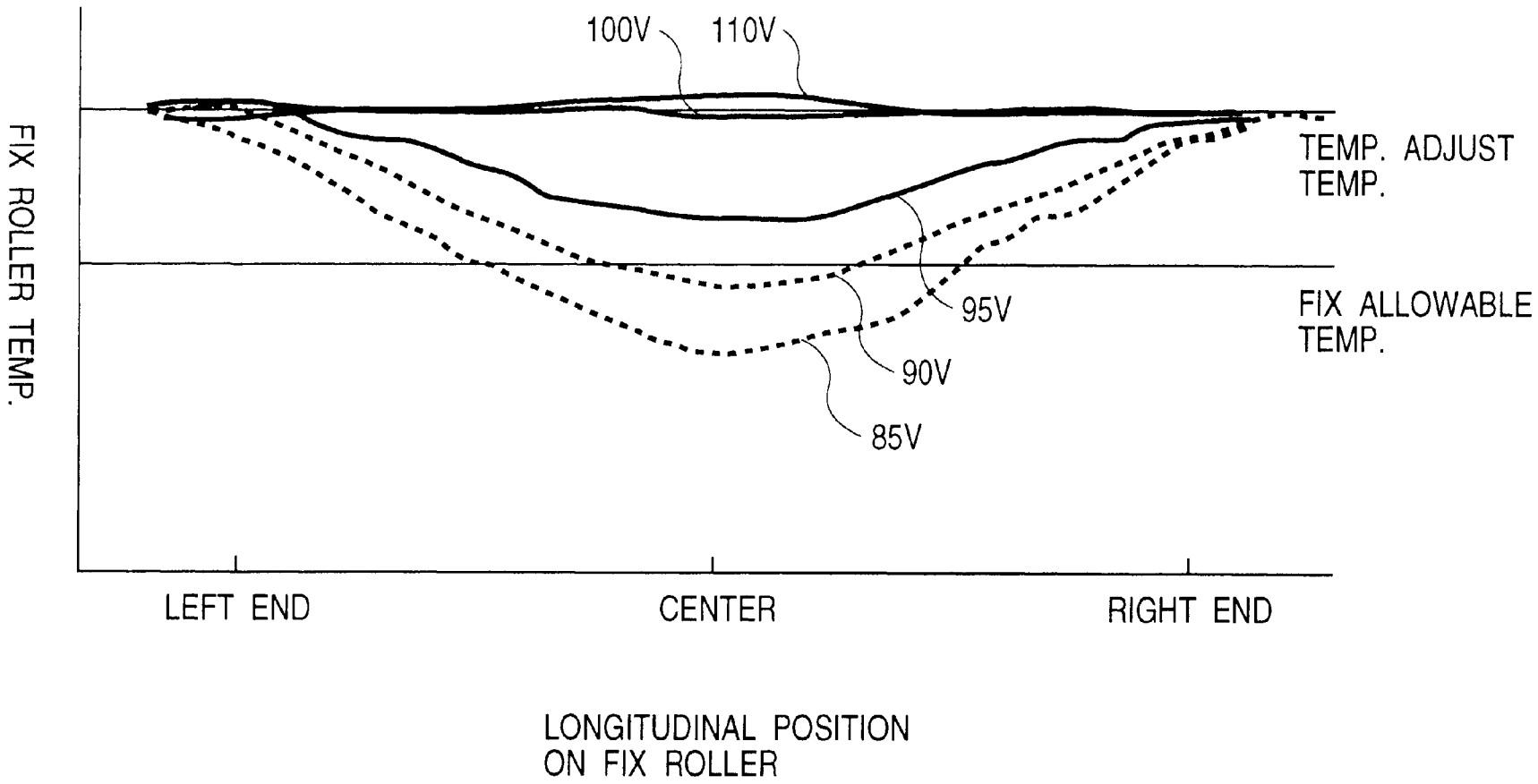
FIG. 8 is a chart showing the temperature distribution on the fixing roller when the input voltage is varied.
Figure 12:
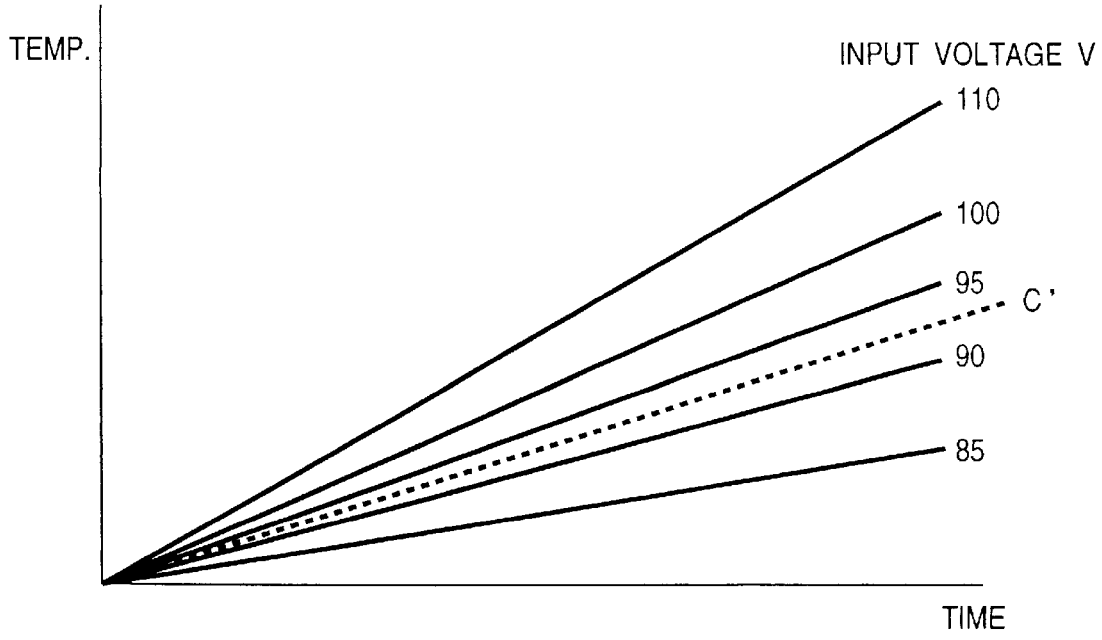
FIG. 12 is a chart showing the difference in the temperature change rate of the fixing roller, depending on the input voltage.

In the following embodiments, the control increase rate as a function of the sheet weight, but the present invention is applicable also to the fluctuation in the input voltage, as explained in the following. FIGS. 12 and 8 respectively show the temperature increase rate in the initial stage of printing operation and the temperature distribution on the fixing roller, for different input voltages in a printing operation on the sheets of 128 g/m$^2$. A control as explained in the foregoing is possible by switching the control according to a temperature slope C' corresponding to about 93 V. If the image forming apparatus itself is provided with a device for detecting the power supply voltage, it is possible to set the control parameters respectively for the input voltage and for the sheet weight. Even if such detecting device is absent, the stable fixing ability can be constantly secured even for simultaneous fluctuations in the input voltage and in the sheet weight, by adopting a temperature increase rate capable of securing the fixing ability, for the criterion of judgment. In such case, if the input voltage is equal to the rated voltage, the control is switched solely depending on the sheet weight, and, if the input voltage is lower than the rated voltage, the control is switched depending on both the input voltage and the sheet weight, according to the larger one of C corresponding to the sheet size and C'.

As explained in the foregoing, according to the present invention there is provided heating condition determination means, which estimates the sheet weight or the input voltage from the temperature change rate while a sheet passes through the nip and which determines the image heating condition such as the throughput of the sheets or the controlled temperature, according to the temperature change rate. It is therefore rendered possible to stably secure the fixing performance in the continuous printing operation, regardless of the weight of the recording sheets or the fluctuation in the input voltage.

What is claimed is:

1. An image heating device comprising:

a heating member;

a backup member for forming a nip in cooperation with said heating member;

a temperature detecting element for detecting a temperature of said heating member during passing of a recording sheet through the nip; and heating condition determination means for determining a heating condition of said heating member, according to a change rate of the temperature detected by said temperature detecting element while a recording sheet is passing through the nip.

2. An image heating device according to claim 1, wherein said heating condition determination means is adapted to determine a rate at which recording sheets are passed through the nip, according to the change rate of the detected temperature.

3. An image heating device according to claim 1, wherein said heating condition determination means is adapted to determine a controlled temperature of said heating member, according to the change rate of the detected temperature.

4. An image heating device according to claim 1, wherein said heating member includes plural heat generating members for generating the heat by a current supply, and said heating condition determination means determining the current supply ratio to said plural heat generating members, according to the change rate of the detected temperature.

* * * * *